US009950327B2

(12) United States Patent
Lin et al.

(10) Patent No.: US 9,950,327 B2
(45) Date of Patent: Apr. 24, 2018

(54) WATERWAY SWITCHING DEVICE AND A SHOWER HEAD INCLUDING THE DEVICE

(71) Applicants: XIAMEN SOLEX HIGH-TECH INDUSTRIES CO., LTD., Xiamen, Fujian (CN); Huasong Zhou, Fujian (CN)

(72) Inventors: Fengde Lin, Fujian (CN); Wenxing Chen, Fujian (CN); Mingfu Zhang, Fujian (CN); Huasong Zhou, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 281 days.

(21) Appl. No.: 14/882,053

(22) Filed: Oct. 13, 2015

(65) Prior Publication Data

US 2017/0100727 A1 Apr. 13, 2017

(51) Int. Cl.
*B05B 1/18* (2006.01)
*B05B 1/16* (2006.01)

(52) U.S. Cl.
CPC ..... *B05B 1/18* (2013.01); *B05B 1/1636* (2013.01)

(58) Field of Classification Search
CPC ..... B05B 1/18; B05B 1/1663; B05B 1/1672; B05B 1/185; B05B 1/1654; B05B 1/1681; B05B 1/16; B05B 1/1609; B05B 1/1618; B05B 1/1627; B05B 1/1636; B05B 1/1645
See application file for complete search history.

(56) References Cited

U.S. PATENT DOCUMENTS 3,722,800 A * 3/1973 Shames ..... B05B 1/1663 137/625.48
3,929,287 A * 12/1975 Givler ..... B05B 1/083 239/381
3,967,783 A * 7/1976 Halsted ..... B05B 1/1663 239/381
4,089,471 A * 5/1978 Koenig ..... B05B 1/083 239/381

(Continued)

FOREIGN PATENT DOCUMENTS

CN 201702050 1/2011
DE 202010005256 U1 * 5/2011 ..... B05B 1/1663
EP 2848314 A1 * 3/2015 ..... B05B 1/18

*Primary Examiner* — Steven J Ganey
*Assistant Examiner* — Steven M Cernoch
(74) *Attorney, Agent, or Firm* — Rabin & Berdo, P.C.

(57) ABSTRACT

A waterway switching device for a shower head includes a fixation portion, a switching mechanism, a driving mechanism, and an adjusting set rotatably disposed in the fixation portion. The fixation portion has an inlet waterway and at least two diversion waterways. The switching mechanism is assembled in the fixation portion and includes a water diversion plate, a first drive mechanism and a valve shaft. The water diversion plate can move with respect to the fixation portion, the valve shaft can slide with respect to the fixation portion, the first drive mechanism is connected to the water diversion plate and the valve shaft, the valve shaft sliding once drives the water diversion plate to rotate at a certain angle to switch and connect one diversion waterway to the inlet waterway. The driving mechanism includes-a rotation shaft and a second drive mechanism.

12 Claims, 8 Drawing Sheets

(56) References Cited

U.S. PATENT DOCUMENTS 5,172,866 A * 12/1992 Ward ..... B05B 1/1663 239/446
5,918,811 A * 7/1999 Denham ..... B05B 1/08 239/123
6,533,194 B2 * 3/2003 Marsh ..... B05B 1/1645 239/381
6,550,697 B2 * 4/2003 Lai ..... B05B 1/1636 137/801
6,641,057 B2 * 11/2003 Thomas ..... B05B 1/1663 239/104
7,111,798 B2 * 9/2006 Thomas ..... B05B 1/1663 239/114
7,322,535 B2 * 1/2008 Erdely ..... B05B 1/1654 239/391
7,670,305 B2 * 3/2010 Zhadanov ..... A61H 7/005 15/29
7,789,326 B2 * 9/2010 Luettgen ..... B05B 1/1636 239/443
8,066,203 B2 * 11/2011 Zhou ..... B05B 1/1636 239/443
8,066,204 B2 * 11/2011 Petrovic ..... B05B 1/1609 239/443
8,109,450 B2 * 2/2012 Luettgen ..... B05B 1/1636 239/443
8,573,512 B2 * 11/2013 Hu ..... B05B 1/1663 239/443
8,616,470 B2 * 12/2013 Williams ..... E03C 1/0409 137/801
9,233,379 B2 * 1/2016 Zhou ..... B05B 1/18
9,427,749 B2 * 8/2016 Zhou ..... B05B 1/1636
2006/0261191 A1 * 11/2006 Chang ..... B05B 1/1663 239/525
2008/0156902 A1 * 7/2008 Luettgen ..... B05B 1/1636 239/447
2012/0012676 A1 * 1/2012 Hu ..... B05B 1/1663 239/525
2013/0284823 A1 * 10/2013 Zhou ..... B05B 1/18 239/438

* cited by examiner

WATERWAY SWITCHING DEVICE AND A SHOWER HEAD INCLUDING THE DEVICE

FIELD OF THE INVENTION

The present invention relates to a waterway switch device and a shower head applied with the device.

BACKGROUND OF THE INVENTION

A switch device of shower functions is disclosed in the Chinese patent database in 2011 Jan. 12 with the announcing number CN201702050U. The device is disposed to a hand shower head, it mainly comprises a valve sleeve, a spindle shaft, a lock hook, a dial button and jointed a top cover and a lower cover; the valve shaft is disposed with a sleeve hole that passes through the valve sleeve vertically, the central portion is disposed with a notch, one side of the notch is fixedly disposed with an elastic piece; the spindle shaft is rotatably disposed in the sleeve hole of the valve sleeve in sealing way, the spindle shaft is disposed with a through hole, and it is arranged with ratchets in the periphery corresponding to the notch of the valve sleeve; the lock hook and the dial button are movably disposed above the valve sleeve, and the lock hook is positioned corresponding to the ratchets of the spindle shaft, one end of the lock hook is fixedly connected to the dial button, while the other end is engaged to the ratchets of the spindle shaft, when the dial button moves, it drives the lock hook and the spindle shaft to rotate so as to switch the functions; with above combination of the components, the entire structure is disposed in the chamber formed between the jointed top cover and lower cover, and the top cover is disposed with an opening for the dial button. The structure is complicated, and it needs large force to switch, thus making the switch inconvenient.

SUMMARY OF THE INVENTION

The present invention is provided with a waterway switch device of a shower head, which overcomes the disadvantages of the switch device of the existing known technology.

A technical proposal of the present invention to solve the technical proposal is that:

A waterway switch device, comprising:

a fixation portion with an inlet waterway and at least two diversion waterways that are capable of connect to the inlet waterway;

wherein further comprising:

a switch mechanism assembled in the fixation portion and comprising a water diversion plate, a first driving mechanism and a valve shaft, the water diversion plate can move with respect to the fixation portion, the valve shaft can slide with respect to the fixation portion, the first driving mechanism is connected to the water diversion plate and the valve shaft, the valve shaft sliding one round can drive the water diversion plate to rotate at a certain angle, the water diversion plate rotates to make the diversion waterways switched to connect to the inlet waterway; and a driving mechanism that comprises a rotation shaft and a second driving mechanism, the rotation shaft is connected to the fixation portion in rotating way and rotates in an initial position and a switch position; the second driving mechanism is connected to the valve shaft in driving way, with the second driving mechanism, the rotation shaft, when rotating, can drive the valve shaft to slide.

In another preferred embodiment, it further comprises:

an adjusting set that is rotatably disposed in the fixation portion and is cooperated with the inlet waterway, the adjusting set rotates with respect to the fixation portion so as to realize the on-off control to the inlet waterway; therein: the rotation shaft rotates in an initial position and a water-stop position, the initial position is disposed between the switch position and the water-stop position; the rotation shaft is fixedly connected to the adjusting set, when the rotation shaft rotates between the initial position and the switch position, the second driving mechanism works at the same time, the rotation shaft and the valve shaft are linked, when the rotation shaft rotates between the initial position and the water-stop position, the second driving mechanism doesn't work, the rotation shaft and the valve shaft are disconnected.

In another preferred embodiment, the second driving mechanism comprises a break component fixedly connected to the rotation shaft and a seesaw piece pivoted joint to the fixation portion, the break component is eccentrically fixedly connected to the rotation shaft, one end of the seesaw piece is connected to the valve shaft in dial way, the break component can abut against the other end of the seesaw piece, when the rotation shaft rotates between the initial position and the switch position, the break component abuts against the other end of the seesaw piece, when the rotation shaft rotates between the initial position and the water-stop position, the break component leaves from the other end of the seesaw piece.

In another preferred embodiment, the seesaw piece is Z shaped, the end of the seesaw piece is a shifting fork, a fixation pin is fixedly disposed at the top end of the valve shaft, the shifting fork is inserted to the top end of the valve shaft, the fixation pin abuts against the top portion of the shifting fork.

In another preferred embodiment, the driving mechanism further comprises an elastic body and an arc body; one end of the elastic body abuts against the fixation portion, the arc body is fixedly disposed to the rotation shaft, when the rotation shaft is placed at the initial position, the arc body abuts against the other end of the elastic body and the elastic body is in the natural state, the arc body and the elastic body are arranged in the same direction as the initial position and the switch position.

In another preferred embodiment, the fixation portion is disposed with an arc groove with the axis on the axis of the rotation shaft, one end of the arc groove is closed to form a close end, the other end is an opening; the elastic is disposed in the arc groove with one end abutting against the close end of the arc groove; the arc body is coupled to and slidably connected to the opening and the arc body can connected to the arc groove in sliding way.

In another preferred embodiment, the fixation portion comprises an inlet pipe, an inlet passage being a part of the inlet waterway is formed in the inlet pipe; the adjusting set is coupled to be disposed in the inlet pipe, the adjusting set is protruding with a protruding block, the inlet pipe is disposed with an arc through groove throughout inside and outside, the protruding block is connected to the arc through groove and extended out of the arc through groove in sealing and sliding way, the rotation shaft is fixedly connected to the protruding block; the inlet passage is disposed with an inlet hole, the adjusting set is disposed with a water hole, the water hole is coupled to the inlet hole, the adjusting set rotates with respect to the fixation portion that can control the connecting of the water hole and the inlet hole so as to control the waterway.

In another preferred embodiment, the switch mechanism further comprises a spring, the spring is sleeved on the valve shaft and the spring abuts against the water diversion plate and the fixation portion, the first driving mechanism, the valve shaft, the spring and the water diversion plate are cooperated to form an automatic pen mechanism or a part of the automatic pen mechanism.

In another preferred embodiment, the fixation portion is disposed with a water diversion body and a fixation set, the water diversion body and the fixation seat are fixedly connected, a water diversion cavity is formed between the water diversion body and the fixation set, the water diversion cavity is connected to the inlet waterway; the water diversion cavity is disposed with a cavity bottom on the top surface of the water diversion body; the valve shaft is extending out of the water diversion cavity from inside to outside, the water diversion plate is disposed in the water diversion cavity; the cavity bottom is disposed with water diversion holes corresponding to the diversion waterways, the water diversion plate is rotatable to switch the water diversion holes;

the bottom surface of the water diversion cavity is concaved with a groove, the groove is disposed with a plurality of first ratchets annularly arranged; the lower end of the valve shaft is disposed with a plurality of second ratchets annularly arranged;

the water diversion plate is disposed with a through hole, the periphery portion of the bottom surface of the water diversion plate corresponding to the through hole is disposed with a plurality of third ratchets annularly arranged; the through hole is sleeved on the valve shaft, the third ratchets are engaged to the first ratchets, the second ratchets are engaged to the third ratchets, the first ratchets are disposed in the groove.

Another technical proposal of the present invention is that:

A shower head applied with the waterway switch device, wherein further comprising a main body, an outlet cover plate and an upper cover, the main body is fixedly connected to the upper cover and forming a chamber, the device is assembled in the chamber, the outlet cover plate is fixedly connected to the main body with at least two outlet waterways with different water types, the at least two outlet waterways are respectively connected to the at least two diversion waterways one by one.

Comparing to the existing technology, the technical proposal of the present invention not only solves the technical problems of the existing technology, but also has advantages as follows;

The rotation shaft rotates and repositions between the initial position and the switch position to switch the waterways in cycle way, it is labor saving and the structure is compact, it also operates conveniently and fast.

The rotation shaft rotates and repositions between the initial position and the switch position to switch the waterways in cycle way, the waterway is controlled on-off when rotating between the initial position and the water-stop position, switch and water stop are combined, the structure is simple, the switch type is new and it can be operated with single hand.

The second driving mechanism comprises the seesaw piece and the break component to form a clutch mechanism, the structure is simple, and with the lever structure, it is labor saving.

The first driving mechanism comprises ratchets, when the water diversion plate is switched, it is raised to be away from the cavity bottom, it rotates and switches with less friction force, so that it is labor saving with lengthened service life.

The seesaw piece is Z shaped, one end is a shifting fork, the upper end of the valve shaft is fixedly disposed with a fixation pin, the shifting fork is inserted to the upper end of the valve shaft, the fixation pin abuts against the shifting fork, the structure is simple and compact, and it is labor saving.

With the elastic body and the arc body, the elastic body stores energy from the initial position to the switch position, the rotation shaft can reposition, when between the initial position and the water-stop position, the elastic body is always in its natural state, the structure is compact.

BRIEF DESCRIPTION OF THE DRAWINGS

The present invention will be further described with the drawings and the embodiments.

DETAILED DESCRIPTION OF THE EMBODIMENTS

Figure 1:
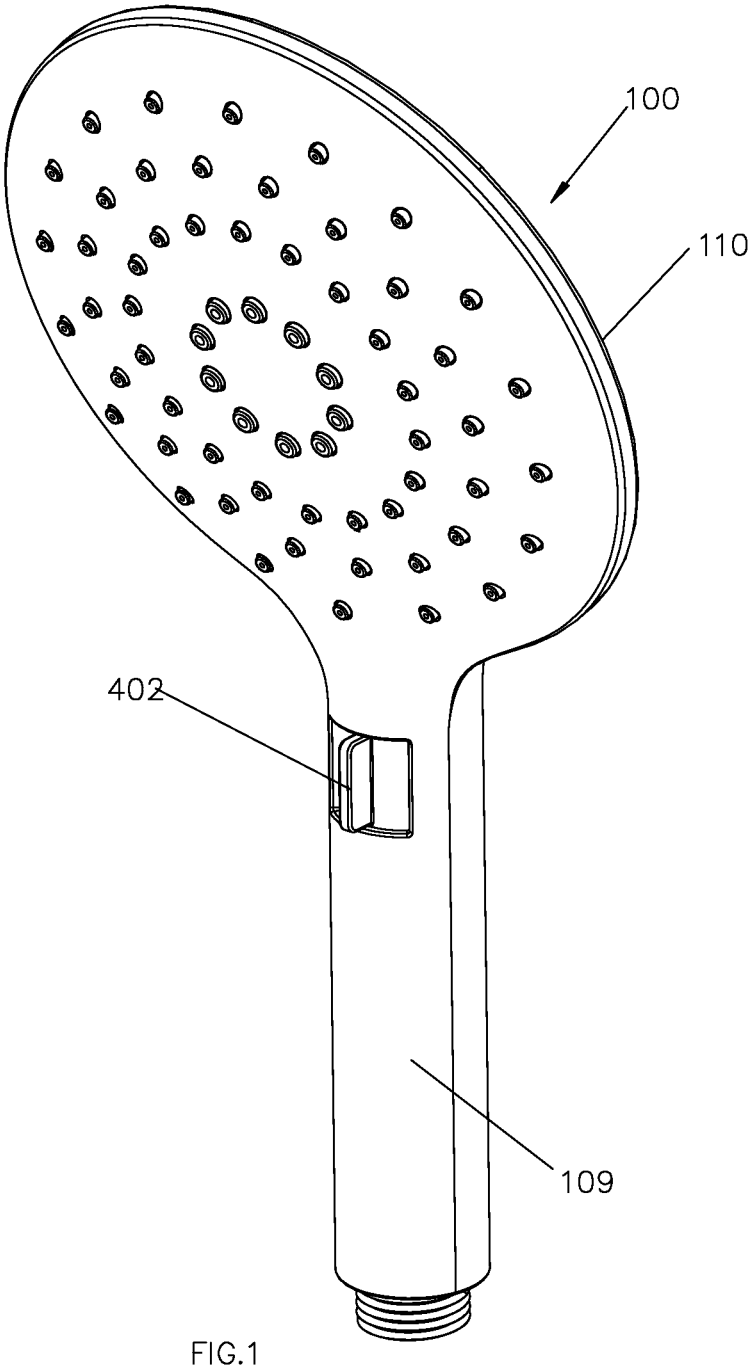
FIG. 1 illustrates a schematic diagram of the shower head.
Figure 2:
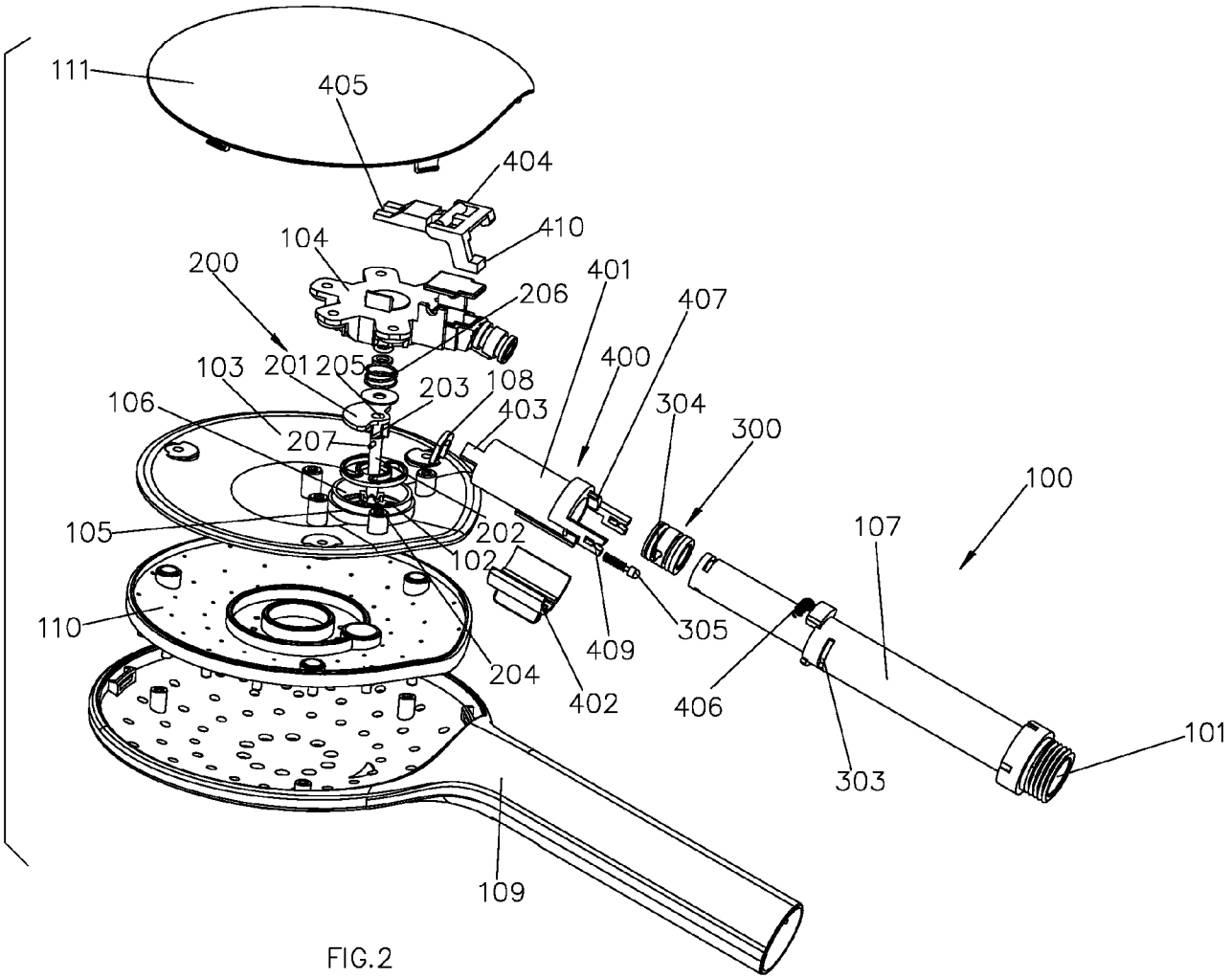
FIG. 2 illustrates an exploded and schematic diagram of the shower head.
Figure 3:
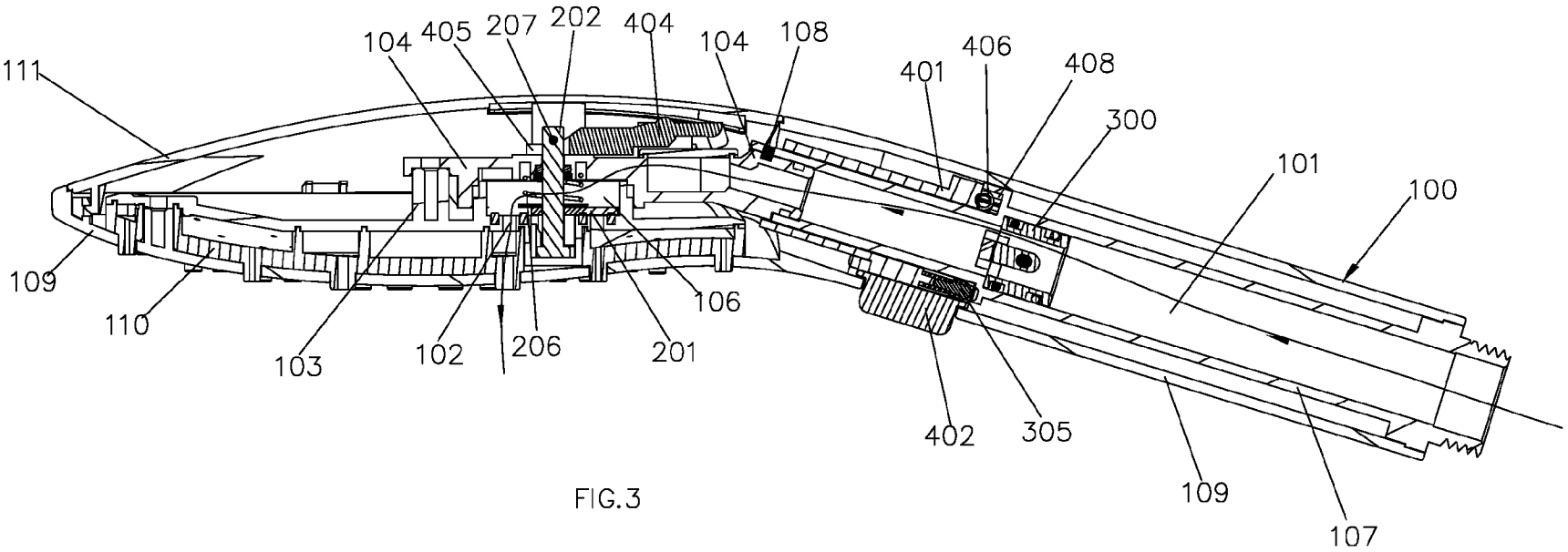
FIG. 3 illustrates a sectional diagram of the shower head when the shower head outflows internal circle shower water.
Figure 4:
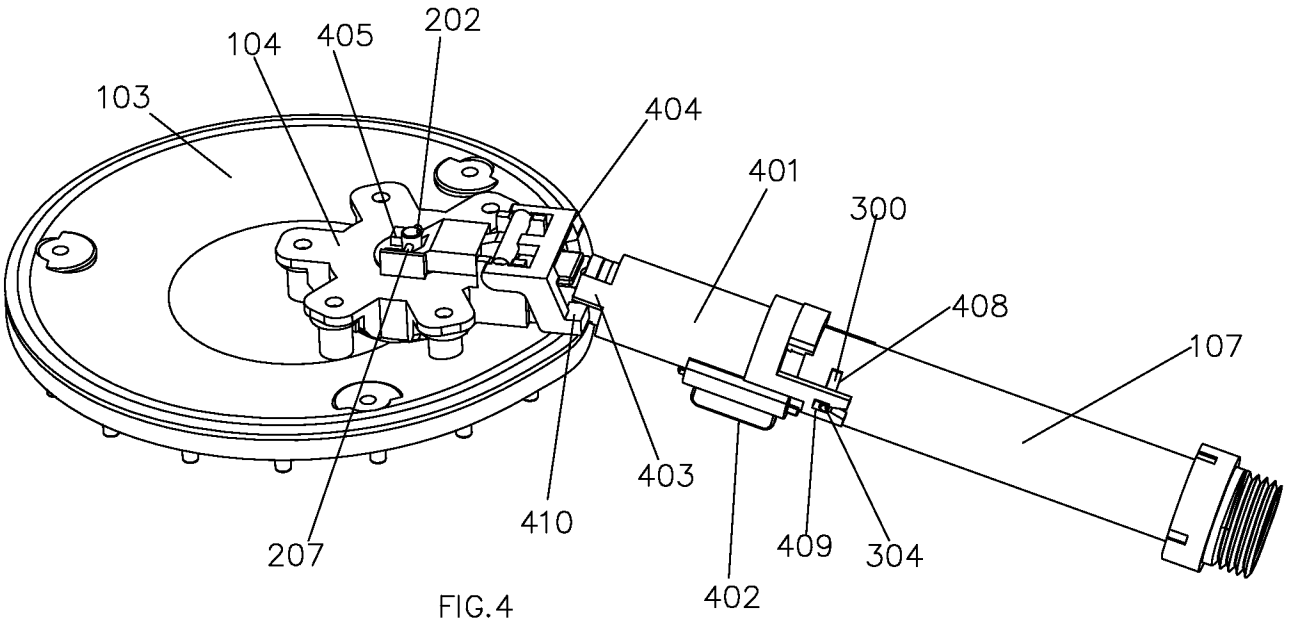
FIG. 4 illustrates a partial schematic diagram of the shower head.
Figure 5:
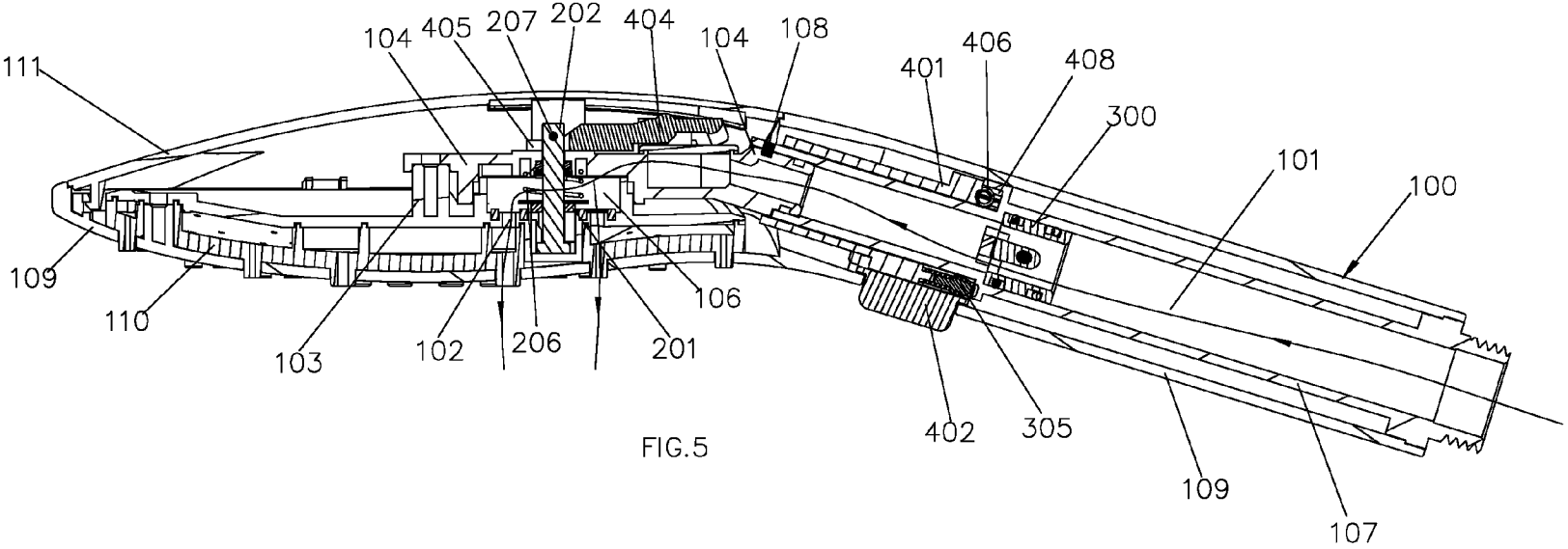
FIG. 5 illustrates a sectional diagram of the shower head when the shower head outflows mixing water.
Figure 6:
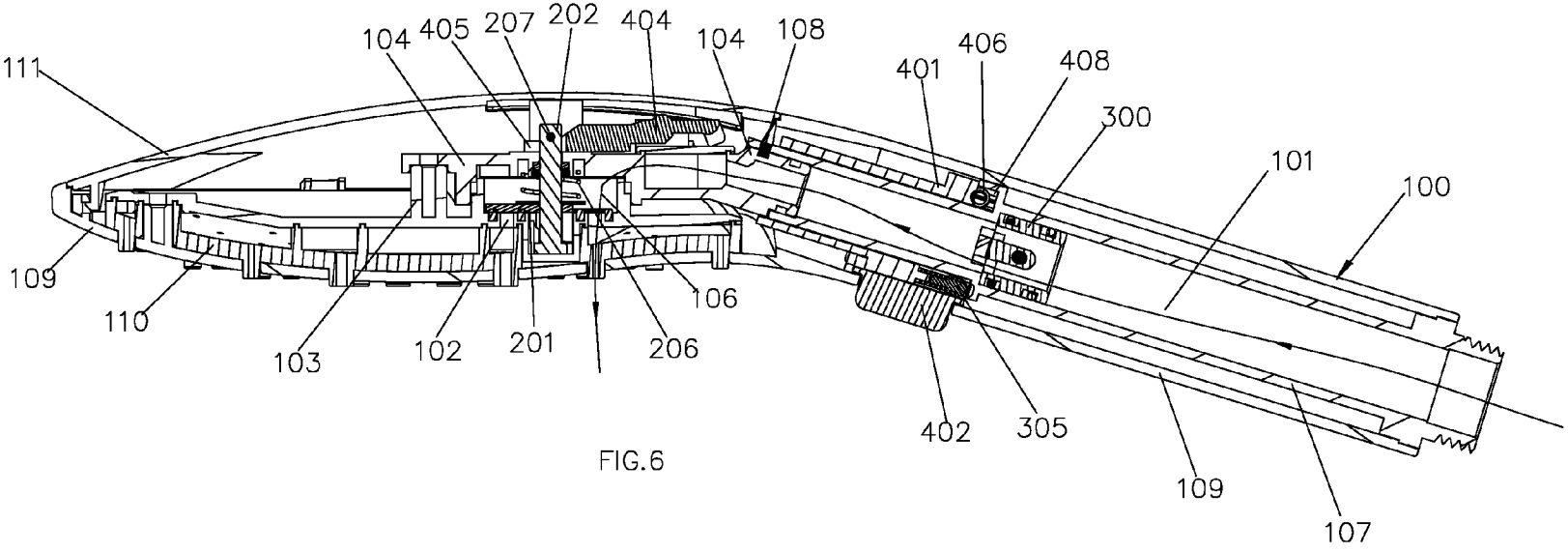
FIG. 6 illustrates a sectional diagram of the shower head when the shower head outflows external circle shower water.
Figure 7:
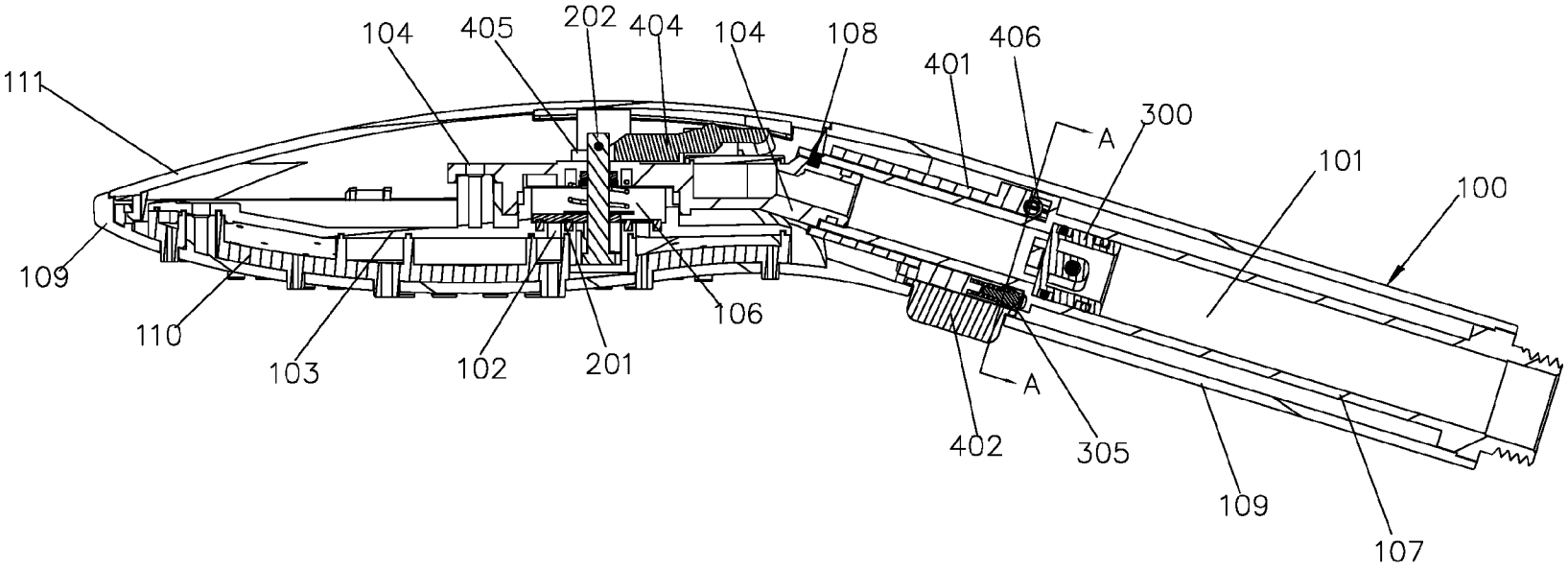
FIG. 7 illustrates a sectional diagram of the shower head when no water flows out of the shower head.
Figure 8:
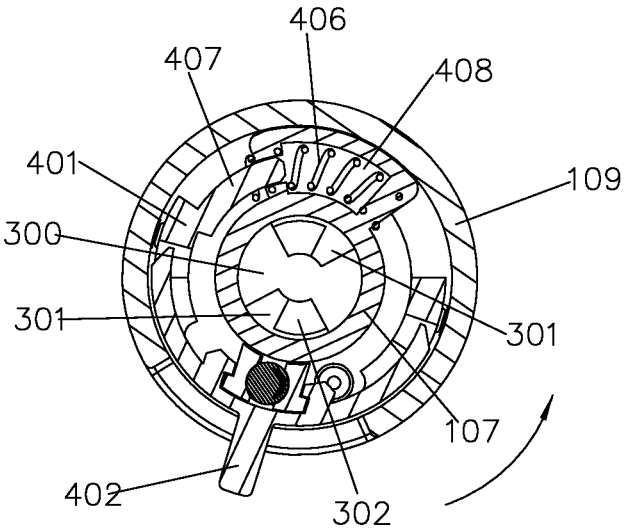
FIG. 8 illustrates a sectional diagram of FIG. 8 in A-A section.
Figure 9:
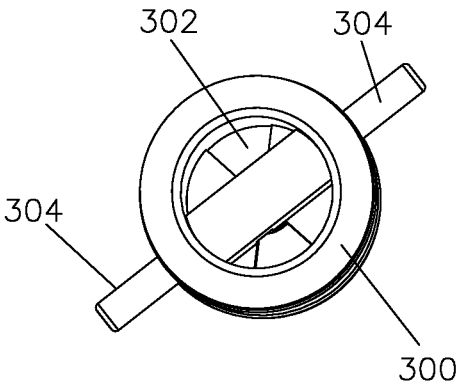
FIG. 9 illustrates a schematic diagram of the adjusting set.
Figure 10:
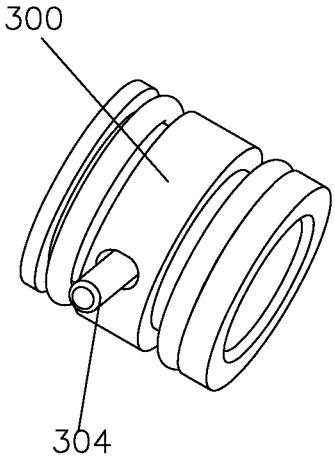
FIG. 10 illustrates a second schematic diagram of the adjusting set.

Please referring to FIGS. 1~10, a waterway switch device comprises a fixation portion 100, a switch mechanism 200, an adjusting set 300 and a driving mechanism 400.

The fixation portion 100 is disposed with an inlet waterway 101 and at least two diversion waterways 102 that can be connected to the inlet waterway 101. In detailed, the fixation portion 100 is disposed with a water diversion body 103 and a fixation set 104, the top surface of the water diversion body 103 is protruding with an annular wall 1105, the fixation set 104 is fixedly connected to the annular wall 105 in sealing way, so that a water diversion cavity 106 in the annular wall 105 is formed between the water diversion body 103 and the fixation set 104, the water diversion cavity 106 is connected to the inlet waterway 101; the water diversion cavity 106 is disposed with the cavity bottom at the top surface of the water diversion body, the cavity bottom is disposed with diversion holes corresponding to each diversion waterway 102. As needed, the fixation portion 100 further comprises an inlet pipe 107, the inlet pipe 107 is formed with an inlet passage that is being a part of the inlet waterway 101, the fixation set 104 is disposed with a water passage connected to the water diversion cavity, the inlet pipe 107 is fixedly connected to the fixation set 104 and the inlet passage is connected to the water passage. The connecting of the inlet pipe 107 and fixation set 104 can be applied with following structure: a lock ring 108 is used to fix both.

The switch mechanism 200 is assembled in the fixation portion 100 and it comprises a water diversion plate 201, a first driving mechanism and a valve shaft 202, the water diversion plate 201 can move with respect to the fixation portion 100, the valve shaft can slide with respect to the fixation portion 100, the first driving mechanism is connected to the water diversion plate 201 and the valve shaft 202, the valve shaft 202 sliding one round can drive the water diversion plate 201 to rotate in a certain angle, when the water diversion plate 201 rotates, the diversion waterway are switched to connect to the inlet waterway. In an embodiment, the water diversion plate 201 is disposed in the water diversion cavity 106, the valve shaft extends out of the fixation set 104 in sliding way from inside to outside, when the water diversion plate 201 rotates, the water diversion holes are switched. The detailed structure of the first driving mechanism is that: the bottom surface of the water diversion cavity 106 is concaved with a groove, the groove is disposed with a plurality of first ratchets that are annularly arranged; the lower end of the valve shaft 202 is disposed with a plurality of second ratchets 204 that are annularly arranged; the water diversion plate 201 is disposed with a throughout hole 205, the bottom surface of the water diversion plate 201 is disposed with a plurality of third ratchets that are annularly arranged corresponding to the periphery of the throughout hole; the valve shaft is sleeved on the throughout hole, a spring 206 is further disposed to abut against the water diversion plate and the fixation set therebetween, the first ratchets are engaged to the third ratchets, The second ratchets are engaged to the third ratchets, the first ratchets are placed in the groove, so that the water diversion plate 201, the first driving mechanism, the valve shaft 202 and the spring form an automatic pen mechanism. When the switch mechanism 200 switches, the water diversion plate is raised, then it is repositioned and closed, so that it reduces the friction of the water diversion plate and the cavity bottom, thus reducing the needed switch force and lengthening the service life.

The adjusting set 300 is rotatably disposed in the fixation set and is coupled to the inlet waterway, when the adjusting set rotates with respect to the fixation portion, the inlet waterway is on-off controlled. In a detailed structure, the adjusting set 300 is disposed in the inlet pipe 107 is coupling way, the inlet pipe 107 is disposed with a baffle at the inner side, the baffle is disposed with throughout inlet holes 301, the adjusting set 300 can rotate and close the baffle, the adjusting set is disposed with water holes 302; the inlet pipe 107 is disposed with two arc through grooves 303 that are radically symmetrically disposed throughout inside and outside, the adjusting set 300 is protruding outwardly with two protruding blocks 304 radically symmetrically, the protruding blocks 304 are connected to the arc through groove 303 in sealing and sliding way and are extending out of the arc through groove 303; the water holes 302 and the inlet holes 301 are cooperated, when the adjusting set rotates with respect to the inlet pipe, the water holes and the inlet holes are connected to realize the controlling of the waterways.

The driving mechanism comprises a rotation shaft 401, a second driving mechanism and a dial button 402, the dial button 402 is fixedly connected to the rotation shaft 401 so that a user can operate the dial button to drive the rotation shaft 401 to rotate, the rotation shaft is connected to the fixation portion in rotating way and it can rotate between a switch position and a water-stop position, an initial position is disposed between the switch position and the water-stop position. The rotation shaft 401 is fixedly connected to the adjusting set 300, so that when the rotation shaft 401 rotates, it drives the adjusting set 300 to rotate so as to control the flow volume. The second driving mechanism is disposed between the rotation shaft 401 and the valve shaft 202, and it has following function; when the rotation shaft 401 rotates between the initial position and the switch position, the second driving mechanism is in switch on state, the rotation shaft 401 is linked to the valve shaft 202, when the rotation shaft rotates between the initial position and the switch position, it drives the valve shaft 202 to slide; when the rotation shaft 401 rotates between the initial position and the switch position, the second driving mechanism is in separating state, the rotation shaft 401 is disconnected to the valve shaft 202. In this embodiment, the rotation shaft is disposed fixedly with two lock catches 409 that are radically symmetrically arranged, two lock catches are respectively fixedly assembled to the protruding blocks, so that when the rotation shaft rotates, it drives the adjusting set to rotate synchronously.

In a preferred structure, the second driving mechanism comprises a break component 403 fixedly connected to the rotation shaft 401 and a seesaw piece 404 pivoted joint to the fixation portion 100, the break component 403 is eccentrically fixedly connected to the rotation shaft 401; the seesaw piece 404 is Z shaped, one end of the seesaw piece 404 is a shifting fork 405; the shifting fork of the seesaw piece 404 is inserted to the top end of the valve shaft 202, the top end of the valve shaft is further fixedly disposed with a fixation pin 207, the fixation pin 207 abuts against the shifting fork 405, so that when the shifting fork of the seesaw piece 404 is raised, it drives the valve shaft 202 to slide upwardly, the break component 403 can abut against the other end 410 of the seesaw piece 404, when the rotation shaft 401 is between the initial position and the switch position, the break component 403 abuts against the other end of the seesaw piece 403, when the rotation shaft 401 is between the initial position and the water-stop position, the break component is separated from the other end of the seesaw piece, therein, when in the initial position, the seesaw piece 404 is right contacted with the break component. In a detailed structure, the seesaw piece 404 is pivoted joint to the fixation set.

The driving mechanism further comprises an elastic body 406 and an arc body 407 with the axis on the axis of the rotation shaft. The fixation portion 100 is disposed with an arc groove 408 with the axis on axis of the rotation shaft, one end of the arc groove 408 is closed to be a close end, the other end is opening; the elastic body 406 is disposed in the arc groove 408 with its one end abutting against the close end of the arc groove 408, the arc body 407 is fixedly disposed to the rotation shaft 401, the arc body 407 is connected to the opening in coupling and sliding way and it can be slide to the arc groove 408, when the rotation shaft is in the initial position, the arc body is contacted with the other end of the elastic body and the elastic body in the natural state, the arc body, the elastic body are arranged with the same direction as the initial position and the switch position. In a detailed structure, the rotation shaft is sleeved on the inlet pipe in rotating way, the inlet pipe is protruding with an arc set, the arc groove is disposed to the arc set.

To further describe the embodiment, the working process of the present invention will be described:

When the dial button 402 rotates in the clockwise direction, it drives the rotation shaft 401 to rotate from the initial position to the switch position, at this time: the arc body 407 abuts against the elastic body 406 to make the elastic body 406 compressed to store energy, the break component 403 presses the end of the seesaw piece 404 down to make the seesaw piece 404 to swing, the shifting fork 405 of the seesaw piece 404 swings upwardly, the fixation pin 207 drives the valve shaft 202 to slide upwardly; with the first driving mechanism, the valve shaft drives the water diversion plate to rotate in a certain angle, the water diversion plate closes the water diversion hole of the second diversion waterway, so that the water diversion hole of the first diversion waterway is connected to the water diversion cavity, the first diversion waterway outflows a first water type, for example, internal circle shower water; when releasing the dial button 402, the valve shaft is repositioned with the action of the spring, the rotation shaft is repositioned to the initial position with the action of the elastic body.

Rotating in clockwise direction can switch the diversion waterways in cycles, for example, it switches the internal circle shower water, the mixing water (internal circle shower water and external circle shower water) and the external circle shower water.

When the dial button 402 rotates in counter clockwise direction, it drives the rotation shaft 401 to rotate from the initial position to the water-stop position, at this time: the arc body 407 rotates away from the elastic body 406, when rotating, the elastic body is always in its natural state; the break component is away from the seesaw piece that avoids the rotation shaft linking to the seesaw piece; the rotation shaft drives the adjusting set to rotate so as to stop water. During this process, the elastic body doesn't store energy, so that it would not reposition automatically, the rotation shaft would not reposition automatically after the user releases his control to the dial button.

To improve the switch hand feel, preferred, a position mechanism is disposed between the rotation shaft and the inlet pipe: it comprises two position grooves disposed in the inlet pipe, the rotation shaft is concaved with an assembly groove, an withstood spring is assembled in the assembly groove, the end of the withstood spring abuts against a position pin 305, the position pin 305 is inserted to the position groove in coupling way, when in the initial position, the position pin is inserted to one position groove, when in the water-stop position, the position pin is inserted to the other position groove, the users can feel gears during the process, so as to obtain a switch hand feel.

A hand shower head applied with above device comprises a main body 109, an outlet cover plate 110 and an upper cover 111, the main body is fixedly connected to the upper cover and forming a chamber that the device is assembled in the chamber. In a detailed structure, the main body 109 has a hand portion and a head portion, the head portion is fixedly connected to the upper cover 111; the head portion is disposed with a plurality of through holes, the outlet cover plate 110 is fixedly connected to the head portion and the outlet nozzles of the outlet cover plate 110 pass through the through holes one by one correspondingly; the water diversion body is fixedly connected to the outlet cover plate 110, it has at least two outlet waterways that can outflow various water types, the outlet waterways are connected to the diversion waterways one by one correspondingly. The inlet pipe passes through the hand portion of the main body, so as to lead the external water source to the water diversion cavity. The hand portion is disposed with a through hole, the dial button extends out of the through hole for the user to operate.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A waterway switching device, comprising:

(a) a fixation portion comprised of:

an inlet waterway; and at least two diversion waterways that are connectable to the inlet waterway;

(b) a switching mechanism that is provided within the fixation portion and that comprises:

a water diversion plate that is movable with respect to the fixation portion and that rotates to switch the at least two diversion waterways to connect with the inlet waterway;

a first drive mechanism that is connected to the water diversion plate; and a valve shaft that is connected to the first drive mechanism and that is slidable with respect to the fixation portion so that the valve shaft sliding once drives the water diversion plate to rotate at a certain angle to switch and connect one diversion waterway of the at least two diversion waterways to the inlet waterway;

(c) a driving mechanism that is comprised of:

a rotation shaft that is connected to the fixation portion in a rotating way and that rotates between a water-stop position and a switched on position with an initial position being disposed between the water-stop position and the switched on position; and a second drive mechanism that is connected to the valve shaft in a driving way, so that, the rotation shaft, when rotating together with engagement of the second drive mechanism, drives the valve shaft to slide, and (d) an adjusting set that is rotatably disposed in the fixation portion, that is fixedly connected to the rotation shaft, and that cooperates with the inlet waterway so that rotation of the adjusting set with respect to the fixation portion provides on-off control of water flow from the inlet waterway, wherein, (i) when the rotation shaft rotates from the initial position to the switched on position, the second drive mechanism engages at the same time so that the rotation shaft and the valve shaft are linked, and, (ii) when the rotation shaft rotates from the initial position and the water-stop position, the second drive mechanism is not engaged so that the rotation shaft and the valve shaft are not linked and are disconnected.

2. The waterway switching device according to claim 1, wherein the second drive mechanism comprises:

a break component fixedly connected to the rotation shaft; and a seesaw piece pivotally joined to the fixation portion, wherein the break component is eccentrically fixedly connected to the rotation shaft, one end of the seesaw piece is connected to the valve shaft in dial way, the break component abuts against another end of the seesaw piece, and wherein, when the rotation shaft rotates in the initial position and the switched on position, the break component abuts against the another end of the seesaw piece, and when the rotation shaft rotates between the initial position and the water-stop position, the break component moves from the another end of the seesaw piece.

3. The waterway switching device according to claim 2, wherein the seesaw piece has a Z shape, the end of the seesaw piece is a shifting fork, a fixation pin is fixedly disposed at a top end of the valve shaft, the shifting fork is inserted into the top end of the valve shaft, and the fixation pin abuts against the top portion of the shifting fork.

4. The waterway switching device according to claim 1, wherein the driving mechanism further comprises:

an elastic body having one end that abuts against the fixation portion; and an arc body that is fixedly disposed to the rotation shaft so that, when the rotation shaft is placed at the initial position, the arc body abuts against another end of the elastic body and the elastic body is in a natural state, wherein the arc body and the elastic body are arranged in the same direction as the initial position and the switch position.

5. The waterway switching device according to claim 4, wherein the fixation portion is disposed with an arc groove having an axis that is the same as that of the rotation shaft, one end of the arc groove being closed to form a closed end, another end of the arc groove being an opening, and the elastic body being disposed in the arc groove with one end abutting against the closed end of the arc groove, and wherein the arc body is coupled to and slidably connected to the opening and the arc body is slidably connectable to the arc groove.

6. The waterway switching device according to claim 1, wherein the fixation portion comprises an inlet pipe having formed therein an inlet passage that is a part of the inlet waterway, wherein the adjusting set is coupled to be disposed in the inlet pipe and includes a protruding block so that the adjusting set protrudes from the inlet pipe, and wherein the inlet pipe is disposed with an arc through-groove throughout the inside and the outside thereof, the protruding block is connected to the arc through-groove and extends out of the arc through-groove in a sealing and sliding way, the rotation shaft is fixedly connected to the protruding block, the inlet passage is disposed with an inlet hole, the adjusting set is disposed with a water hole that is coupled to the inlet hole, and the adjusting set rotates with respect to the fixation portion to control the connecting of the water hole and the inlet hole so as to control the waterway.

7. The waterway switching device according to claim 1, wherein the switching mechanism further comprises a spring that is sleeved on the valve shaft and that abuts against the water diversion plate and the fixation portion, and wherein the first driving mechanism, the valve shaft, the spring and the water diversion plate cooperate to form an automatic pen mechanism or a part of the automatic pen mechanism.

8. The waterway switch device according to claim 7, wherein the fixation portion is disposed with a water diversion body and a fixation set that are fixedly connected to one another and have defined there between a water diversion cavity that is connected to the inlet waterway and that has a cavity bottom provided on a top surface of the water diversion body, wherein the valve shaft extends is extending out of the water diversion cavity from inside to outside thereof, the water diversion plate is disposed within the water diversion cavity, the cavity bottom has defined therein water diversion holes corresponding to the at least two diversion waterways, and the water diversion plate is rotatable to switch the water diversion holes, wherein the water diversion cavity has a bottom surface that is concaved with a groove, the groove is disposed with a plurality of first ratchets that are annularly arranged, the valve shaft has a lower end that is disposed with a plurality of second ratchets that are annularly arranged, the water diversion plate has defined therein a through hole, the water diversion plate has a bottom surface that has a peripheral portion positioned to correspond to the through hole and disposed with a plurality of third ratchets that are annularly arranged, and wherein the through hole is sleeved on the valve shaft, the third ratchets engage the first ratchets, the second ratchets engage to the third ratchets, and the first ratchets are disposed in the groove.

9. A shower head, comprising:

the waterway switching device according to claim 8;

a main body;

an outlet cover plate; and an upper cover, wherein the main body is fixedly connected to the upper cover and forms a chamber, the waterway switching device is assembled within the chamber, the outlet cover plate is fixedly connected to the main body with at least two outlet waterways having different water types, and wherein each outlet waterway of the at least two outlet waterways is connected to one diversion waterway of the at least two diversion waterways.

10. The waterway switching device according to claim 1, wherein the switching mechanism further comprises a spring that is sleeved on the valve shaft and that abuts against the water diversion plate, and wherein the fixation portion, the first drive mechanism, the valve shaft, the spring and the water diversion plate cooperate to form an automatic pen mechanism or a part of the automatic pen mechanism.

11. The waterway switching device according to claim 10, wherein the fixation portion is disposed with a water diversion body and a fixation set that are fixedly connected to one another and that have defined there between a water diversion cavity that is connected to the inlet waterway and that has a cavity bottom provided on a top surface of the water diversion body, wherein the valve shaft extends out of the water diversion cavity from inside to outside thereof, the water diversion plate is disposed within the water diversion cavity; the cavity bottom has defined therein water diversion holes corresponding to the at least two diversion waterways, and the water diversion plate is rotatable to switch the water diversion holes, wherein the water diversion cavity has a bottom surface that is concaved with a groove, the groove is disposed with a plurality of first ratchets that are annularly arranged, the valve shaft has a lower end that is disposed with a plurality of second ratchets that are annularly arranged, the water diversion plate has defined therein a through hole, the water diversion plate has a bottom surface that has a peripheral portion positioned to correspond to the through hole and disposed with a plurality of third ratchets that are annularly arranged, and wherein the through hole is sleeved on the valve shaft, the third ratchets engage the first ratchets, the second ratchets engage the third ratchets, and the first ratchets are disposed in the groove.

12. A shower head, comprising:

the waterway switching device according to claim 11;

a main body;

an outlet cover plate; and an upper cover, wherein the main body is fixedly connected to the upper cover and forms a chamber, the waterway switching device is assembled within the chamber, the outlet cover plate is fixedly connected to the main body with at least two outlet waterways having different water types, and wherein each outlet waterway of the at least two outlet waterways is connected to one diversion waterway of the at least two diversion waterways.

* * * * *